United States Patent [19]

Ku

[11] Patent Number: 5,011,429

[45] Date of Patent: Apr. 30, 1991

[54] CONNECTION TERMINAL PLATE

[76] Inventor: Hai-Yung Ku, 8th Fl., No. 614, Lin Sen N. Road, Taipei, Taiwan

[21] Appl. No.: 501,702

[22] Filed: Mar. 30, 1990

[51] Int. Cl.[5] ..... H01R 4/24

[52] U.S. Cl. ..... 439/409; 439/417; 439/819

[58] Field of Search ..... 439/789, 817, 818, 819, 439/820, 417, 418, 389, 391, 392, 408, 409, 410, 811, 813, 814

[56] References Cited

U.S. PATENT DOCUMENTS 4,550,970 11/1985 Ogino ..... 439/411

FOREIGN PATENT DOCUMENTS 1430311 1/1966 France ..... 439/391

*Primary Examiner*—David L. Pirlot
*Assistant Examiner*—Julie R. Daulton
*Attorney, Agent, or Firm*—Lowe, Price, LeBlanc, Becker & Shur

[57] ABSTRACT

A wiring connection terminal block having a housing for accommodating a movable block and a compression spring, is arranged within an insulator made of fire-proof synthethic polyester. Two opposite sides of the housing each has a wire hole with oblique surface, forming a sharp wedge at the top rim of each hole. The moveable block has a wire hole with oblique surfaces forming concavities into opposite surfaces of the moveable block. The oblique surfaces are positioned at the bottom rims of the wire holes on the surface of the moveable block and extend into the moveable block. A wire is inserted into the wiring holes by compressing the compressing spring to bring the wiring holes of the moveable block into alignment with the wiring holes of the housing. When the compressing spring is released an inserted wire is pushed upward and bent into the concavities on either side of the moveable block by the force of the compressing spring. Electrical connection between the housing and the inserted wire in the wire holes is created by the sharp wedges on the housing which pierce the wire cover when the wire is forced against the points.

3 Claims, 2 Drawing Sheets

CONNECTION TERMINAL PLATE

BACKGROUND OF THE INVENTION

This invention is directed to an improved structure for an electrical connector, and particularly to a quick-connect multi-purpose wire connection terminal block.

FIG. 1 is a perspective view of a conventional wire connection terminal block, having metal conducting plates 10 arranged in two rows and fastened on an insulator 20 to extend out from opposite sides of the terminal block. Each projecting end of a metal conducting plate has a screw hole 30 to mount a screw 40. To connect a wire, the cover on an end of wire 50 is removed and the bare wire wound around the loosened screw. The screw is then tightened in hole 30 to secure wire 50. This system not only requires substantial time and labor to make connections but also has certain defects such as poor electrical contact, easily broken metal connecting plates, exposure of screws to rust or erosion, and the danger of electric shock.

Another design is a wedge type connection terminal block as shown in FIG. 2. Two rows of wedge openings 60 are arranged on an insulator, and each metal conducting plate has a V-cut opening 70 inside the wedge openings 60. To make connection, a wire is forced into the wedge opening by a special tool to make a tight connection and simultaneously cut through the cover of the wire making electrical contact with the underlying wire copper core. This arrangement has the advantage of not requiring the cover of the wire to be removed to make connection. However, due to inadequate locking force holding the wire to the terminal, defects such as loose wires, poor electrical contact and broken wires occur. Also, a special tool is required for connection of large wires.

SUMMARY OF THE INVENTION

An object of the invention is to solve the problems mentioned above for conventional wire connection terminal blocks and to provide structural improvements.

According to the present invention, a terminal block includes a housing for accommodating a movable block and a compressing spring, all arranged within an insulator made of fire-proof synthetic polyester. The movable block and two corresponding sides of the housing have alignable wire holes. The top rims of the wire holes of the housing are formed in a wedge shape by an oblique surface, and the bottom rims of the wire hole of the movable block are part of concavities formed by oblique surfaces on opposite faces of the moveable block. The moveable block is pushed upward by the compressing spring to vertically displace the wire holes in the housing from that in the moveable block. When connecting a wire, the moveable block is pushed down so that the wire holes of the housing and moveable block are brought into alignment. Then the wire is inserted, the moveable block released and the wire pushed up by the compressing spring. The wire is bent on each side of the moveable block along the concavities by the displacement of the wire holes forced by the compressing spring. The wire cover is pierced by the sharp wedges at the top rim of the housing wire holes.

The top side of the movable block has a hole provided for inserting a connector. The top of the housing is covered by a folding portion with a hole aligned with that on the top of the moveable block.

A more complete understanding of these and other features and advantages of the present invention will become apparent from a careful consideration of the following detailed description of certain embodiments illustrated in the accompanying drawing.

DETAILED DESCRIPTION OF EMBODIMENTS

Figure 1:
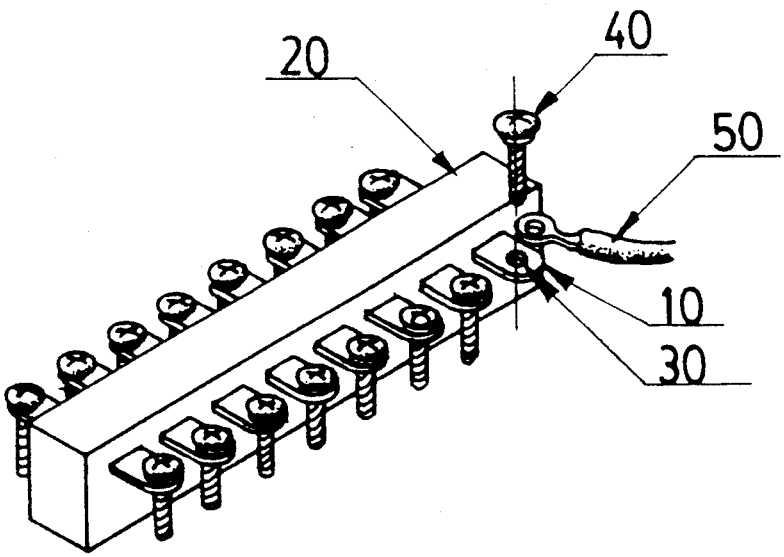
FIG.1 PRIOR ART
FIGS. 1 and 2 are perspective views of conventional terminal blocks.
Figure 2:
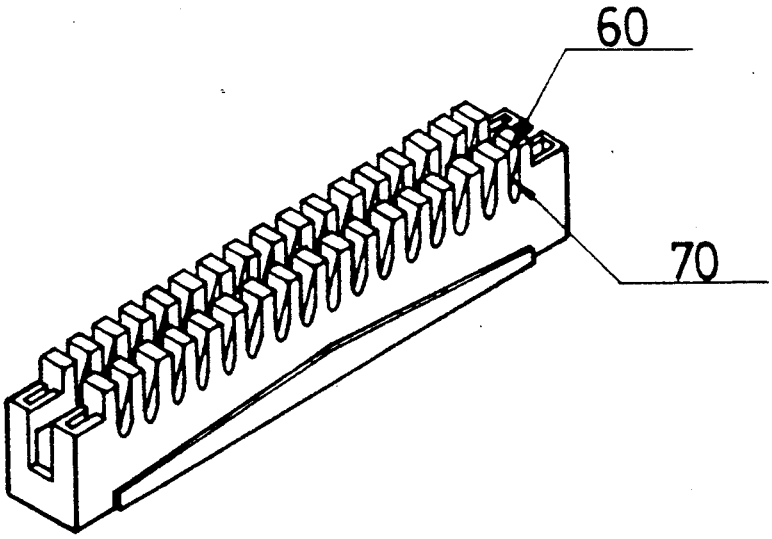
FIG. 2 PRIOR ART
Figure 3:
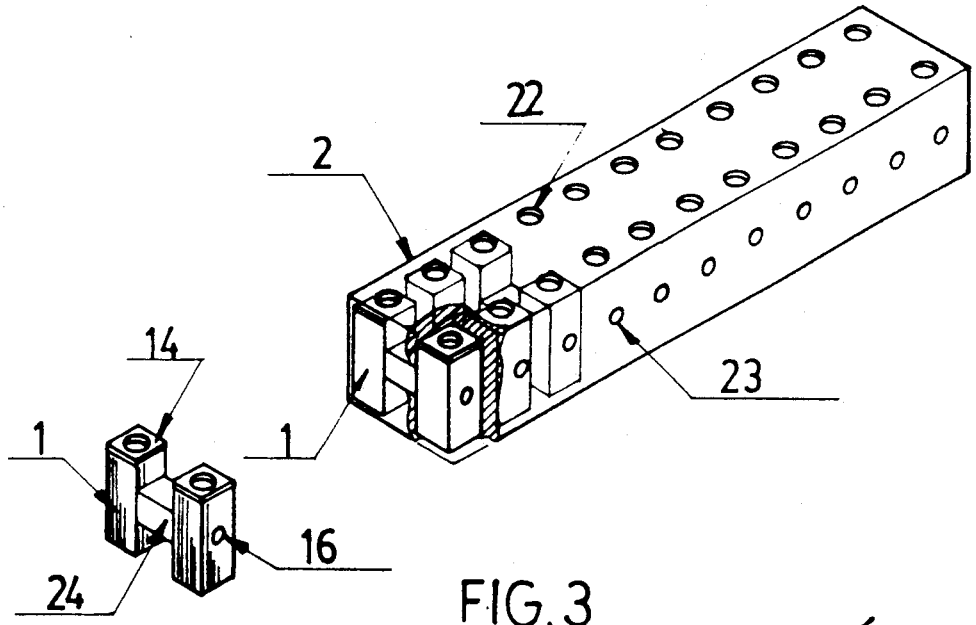
FIG. 3 is a perspective view of the present invention.
Figure 4:
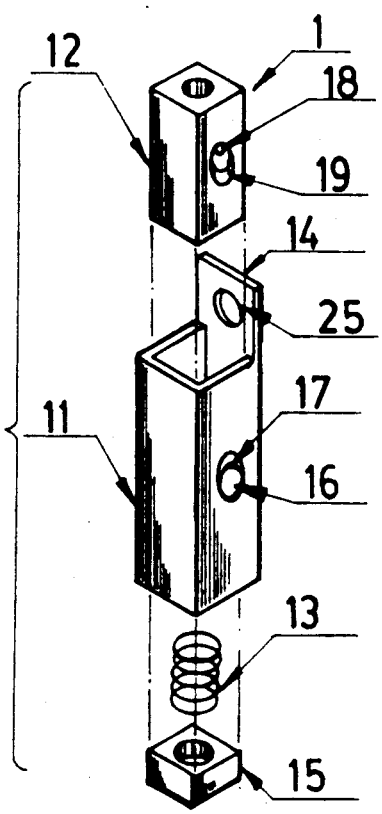
FIG. 4 is an exploded view showing the structure of the terminal block of the present invention.
Figure 5:
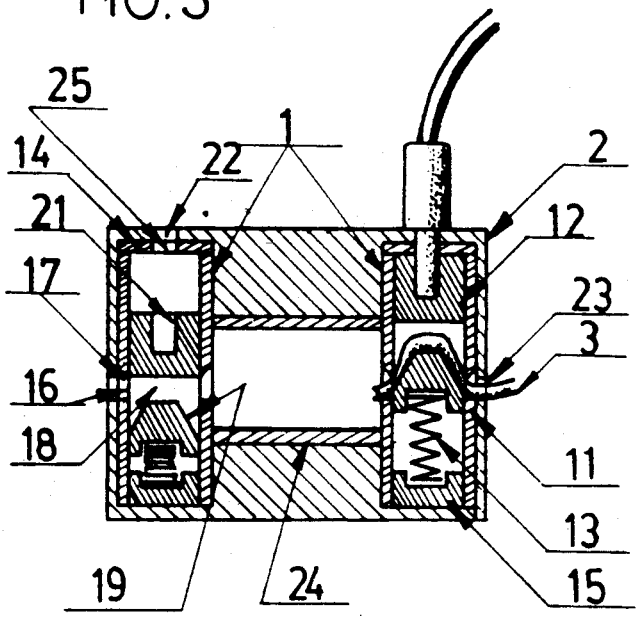
FIG. 5 is a sectional view of the present invention.

Referring to FIGS. 3, 4 and 5, the invention includes a terminal structure 1 with a metal conducting portion and an insulator 2. The terminal structure 1 includes a housing 11 for accommodating a movable block 12 and a compressing spring 13. The upper and lower openings of the housing are closed by folding portion 14 and plug 15, respectively. The terminal is positioned within the insulator 2 made of fire-proof synthetic polyester, shown in the right hand drawing of FIG. 3.

The longitudinal sides of the terminal housing 11 have corresponding wire holes 16, each having a sharp, wedge-shaped surface at a respective top rim edge. The compressing spring 13 is mounted below the movable block. The movable block is pushed upward by the compressing spring 13 to displace the wire holes of the moveable block from those of the housing.

The top face of terminal housing 11 (folding portion 14) and the top face of movable block 12 have aligned socket holes 25 and 21. The top and lateral faces of insulator 2 have holes 22 and 23 corresponding to socket hole 25 and lateral wire hole 16 respectively.

To connect a wire it is not necessary to strip off the cover of the wire or use any special tool. Instead, a common rod-shaped object is inserted through hole 22 on the top face of insulator 2 and into hole 21 on the top face of movable block. By pressing downward to compress the spring 13, the wire hole 16 of the housing and wire hole 18 of the movable block align with each other as depicted in the left side of FIG. 5. When holes 16 and 18 are aligned a wire 3 can be inserted into a hole 23 in the side of insulator, through wire hole 16 of the terminal housing and out through the wire hole 18 of movable block 12.

After the movable block is released it is pushed upward by the compressing spring 13 so that the wire is bent along the concavities at the bottom rim of the moveable block wire hole to form an inverted "U" shape. As a result, the wire is held between the terminal housing 11 and movable block 12. The cover of the wire is pierced by the sharp wedge shaped top rim 17 of wire hole 16 (refer to the terminal as shown in the right side of FIG. 5). Due to the tight spring-biased connection, there is little possibility of the wire breaking and good electrical contact between the wire and the housing is provided.

One advantage of the invention is the capability of using a common rod-shaped object to depress the movable block so that the wire can be easily inserted for connection. The wire cover is pierced by the wedge shaped top rims of the wire holes of housing. This system saves time and labor since it is not necessary to strip off the block wire cover or to use a special tool as required by some prior art terminal. The contact is tight and the wire has little chance of breaking.

Another advantage of the invention is that, the housing for accommodating the movable block and compressing spring is arranged within an insulator made of fire-proof synthetic polyester, providing not only superior insulation but also preventing oxidation-erosion and decreasing the danger of electric shock.

Still another advantage of the invention is its multifunctional capability. For example, the invention is applicable to various bridge taps and sockets, for mounting additional lighting arresting devices on telecommunication equipment, for mounting fuses for electrical equipment and impedance matching devices for information equipment; for providing wire split sections for spot testing purposes and other uses. The convenience and other advantages of the invention for connection work, operation and service/maintenance are superior to those of conventional terminal blocks.

Because terminal structure 1 is positioned within the insulator 2, various connection configurations can be arranged using connection body 24. For example, one-side series and parallel or double-sided series and parallel circuit arrangements can be provided. Other circuit arrangements can be provided by step-shaped, multilayer combinations of terminal blocks.

Many modifications may be made without departing from the basic spirit of the present invention. Accordingly, it will be appreciated by those skilled in the art that within the scope of the appended claims, the invention may be practiced other than has been specifically described herein.

What is claimed is:

1. A wire connection terminal block comprising a metal conducting terminal structure and insulator housing, wherein said terminal structure is positioned within the insulator, said terminal structure comprising:

a housing having two opposite sides with aligned wire holes each of said wire holes having a top rim with an oblique surface forming a wedge;

a movable block having a wire hole with a perimeter on two opposite, faces of the movable block, said perimeter of said wire hole on each said opposite face having a bottom rim with an oblique surface forming a concavity in said face of said moveable block; and a compressing spring, said compressing spring and movable block being accommodated within said housing, said housing having upper and lower openings, said upper opening being covered by a folding portion, said lower opening being covered by a plug, said wire hole of said movable block being normally displaced from said wire holes of said housing by said compressing spring, said wire holes of said housing and said moveable block being alignable when said compressing spring is compressed so that a wire can be inserted through said wire holes in said housing and said moveable block, an inserted wire being bent along said concavities on opposite faces of said moveable block, and a cover of the wire being pierced by said wedges at the top rims of the wire holes of said housing on said opposite faces of said moveable block when said compressing spring is released.

2. The wire connection terminal block as claimed in claim 1, wherein said moveable block has a top face with a socket hole and said folding portion has a socket hole aligned with said socket hole in said top face of said moveable block so that a connector can be inserted in said socket holes.

3. The wire connection terminal block as claimed in claim 2, wherein said insulator has top and lateral faces having top and lateral holes, respectively, aligned with said socket holes and said wire holes of said housing respectively.

* * * * *